US006591072B2

(12) United States Patent
Hashimoto et al.

(10) Patent No.: US 6,591,072 B2
(45) Date of Patent: Jul. 8, 2003

(54) IMAGE FORMING APPARATUS WITH CHANGEABLE TONER RETURNING ELECTRIC FIELD APPLICATION PERIOD

(75) Inventors: Kouichi Hashimoto, Ibaraki-ken (JP); Yuichiro Toyohara, Kanagawa-ken (JP); Ken-ichiro Kitajima, Ibaraki-ken (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/984,692

(22) Filed: Oct. 31, 2001

(65) Prior Publication Data

US 2002/0085859 A1 Jul. 4, 2002

(30) Foreign Application Priority Data

Oct. 31, 2000 (JP) ..... 2000-332273

(51) Int. Cl.[7] ..... G03G 15/00; G03G 15/02
(52) U.S. Cl. ..... 399/50; 399/174
(58) Field of Search ..... 399/174, 175, 399/148, 149, 150, 50, 43, 99, 101, 128, 343, 71, 26, 27

(56) References Cited

U.S. PATENT DOCUMENTS

| | | | | |
|---|---|---|---|---|
| 5,485,248 A | | 1/1996 | Yano et al. | 399/73 |
| 5,835,821 A | | 11/1998 | Suzuki et al. | 399/100 |
| 6,064,837 A | | 5/2000 | Hashimoto et al. | 399/50 |
| 6,088,548 A | | 7/2000 | Hashimoto et al. | 399/50 |
| 6,118,952 A | * | 9/2000 | Furuya | 399/150 X |
| 6,215,967 B1 | | 4/2001 | Takeda et al. | 399/43 |

FOREIGN PATENT DOCUMENTS

| | | |
|---|---|---|
| JP | 5-223513 | 8/1993 |
| JP | 8-220935 | 8/1996 |
| JP | 9-96949 | 4/1997 |

* cited by examiner

*Primary Examiner*—Sophia S. Chen
(74) *Attorney, Agent, or Firm*—Fitzpatrick, Cella, Harper & Scinto

(57) ABSTRACT

An image forming apparatus includes an image bearing member; a charger for electrically charging the image bearing member; an electrostatic image forming device for forming an electrostatic image by selectively discharging a surface of the charged image bearing member; a developer for developing the electrostatic image formed on the image bearing member into a toner image; a transfer device for transferring the toner image from the image bearing member onto a transfer material; wherein the charger is capable of collecting residual toner from the image bearing member after an image transfer operation; an electric field forming device forms an electric field between the charger and the image bearing member to transfer the toner in the charger to the image bearing member; and a controller controls a length of time during which the electric field forming device forms the electric field, wherein the controller controls the length of time substantially in accordance with wear of a surface of the image bearing member.

6 Claims, 9 Drawing Sheets

FIG. 8(a)
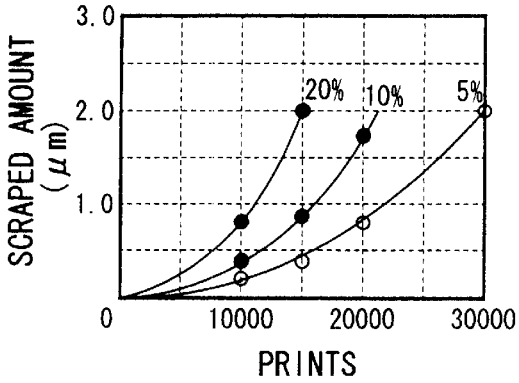
FIG. 8(b)
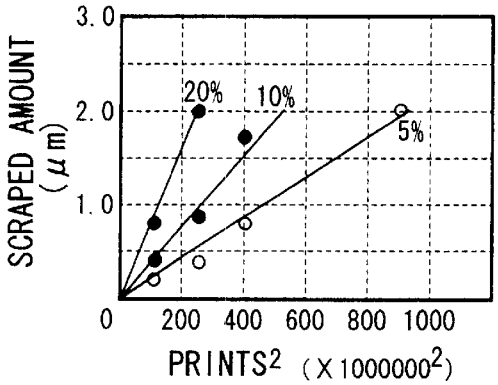
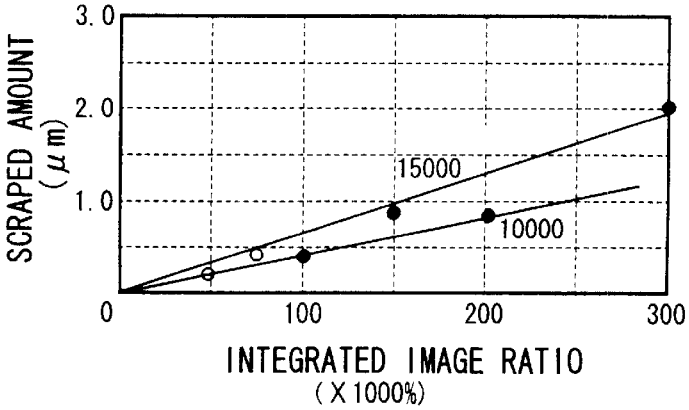
FIG. 8(c)

IMAGE FORMING APPARATUS WITH CHANGEABLE TONER RETURNING ELECTRIC FIELD APPLICATION PERIOD

FIELD OF THE INVENTION AND RELATED ART

The present invention relates to an image forming apparatus such as a copying machine or a printer, of an electrophotographic type or an electrostatic recording type. The image forming apparatus such as a copying machine or a printer has been increasingly downsized. However, the downsizing is saturating because there is a limit in the downsizing only by downsizing each of the image forming process means such as charging means, exposure means, developing means, transfer means, fixing means or cleaning means. Untransferred toner (residual developer) remaining on a photosensitive member after image transfer operation is removed and collected by cleaning means (cleaner) into a residual toner container. The residual toner is desirably minimized from the standpoint of environmental health.

In view of the foregoing, an image forming apparatus using a cleanerless process has been put into practice, in which the cleaner is omitted, and the untransferred toner is removed from the photosensitive member by developing means (simultaneous development and cleaning), and the toner is collected into the developing means and is reused.

In the simultaneous development and cleaning process, a small amount of the toner still remaining on photosensitive member after the image transfer operation is removed in the subsequent developing steps, by application of a fog removing bias voltage (potential difference Vback between a DC voltage applied to the developing means and the surface potential of the photosensitive member). With this process, the untransferred toner is collecting by the developing means and is reused in the subsequent image formation processes. Therefore, the amount of the residual toner reduces, and the maintenance operation is easier.

Because the cleaning means is not provided, the image forming apparatus can be significantly downsized.

In such an image forming apparatus of a cleanerless type, it is desired that a measurement is taken to avoid hysteresis of the previous image. To accomplish this, it is considered that untransferred toner is temporarily collected by the charger. In order to perform the function of collecting the residual toner, an injection charger of a magnetic brush type is suitable. In an image forming apparatus using the magnetic brush injection charging, the uniformity of the charging is influenced by a thickness of a charge injection layer of the photosensitive member. As shown in FIGS. 11(*a*) and 11(*b*), the charge injected into the photosensitive member reaches an interface between the charge injection layer and a charge transfer layer. In the magnetic brush injection charging, the points of contact between the photosensitive member and the charging magnetic particles are discrete, and therefore, it is not possible to flow the electric current throughout the entire surface of the photosensitive member. However, in the charge injection layer, the charge is dispersed in the directions along the surface, thus providing a substantially uniform charged distribution as shown in FIG. 11(*a*). However, when the thickness of the charge injection layer is small as shown in FIG. 11(*b*), the lateral (in the directions along) portion of charge is insufficient with the result of deteriorated uniformity charging.

Particularly when an electroconductive brush is used and is provided between the image transfer station and the charging station and is supplied with a voltage of the polarity opposite from the toner in an attempt to improve the residual toner collection performance of the charger, stripes of latent image of the opposite polarity are formed on the surface of the photosensitive drum. The magnetic particles are not contacted to all of the latent images in the form of stripes, but they are contacted to a part of the latent images. When the thickness of the charge injection layer is small, the latent image of the opposite polarity remains. Although when the thickness of the charge injection layer is sufficient, the lateral dispersion of the electric charge provides the uniform charging to the regular polarity. In the case of the cleanerless system, there is residual toner in the charger, and therefore, the toner is discharged toward the latent image of the opposite polarity, and such toner is unable to be removed by the developing action, with the result of stripes as shown the FIG. 12 which is a sample of such an image.

If the charge injection layer is made thick to a certain extent, it is possible to avoid an increase of the stripe fog attributable to reduction of thickness due to photosensitive member scraping. However, the charge injection layer comprises fine electroconductive particles disbursed therein. Therefore, if the charge injection layer is made thicker, the amount of image light passing through the layer decreases with the result of image deterioration.

SUMMARY OF THE INVENTION

Accordingly, it is a principal object of the present invention to provide an image forming apparatus in which the untransferred toner can be collected by the charger. It is another object of the present invention to provide an image forming apparatus image the toner can be returned onto the image bearing member from the charger. It is a further object of the present invention to provide an image forming apparatus capable of forming a proper length of toner transition electric field in a long term operations According to an aspect of the present invention, there is provided an image forming apparatus, comprising an image bearing member; charging means for electrically charging the image bearing member; an electrostatic image forming means for forming an electrostatic image by selectively discharging the image bearing member charged by the charging means; a developing means for developing the electrostatic image formed on the image bearing member onto a transfer material, wherein the charging means is capable of collecting residual toner from the image bearing member after an image transfer operation is performed by the transfer means; an electric field forming means for forming an electric field between the charging means and the image bearing member to transfer the residual toner from the charging means to the image bearing member; and a control means for controlling a length of time during which the electric field forming means forms the electric field, wherein the control means controls the length of time substantially in accordance with one of a surface of the image bearing member.

These and other objects, features and advantages of the present invention will become more apparent upon a consideration of the following description of the preferred embodiments of the present invention taken in conjunction with the accompanying drawings.

BRIEF DESCRIPTION OF THE DRAWINGS

FIGS. 8(*a*), 8(*b*), and 8(*c*) illustrates an amount of photosensitive member scraping in relation to an integrated number of image forming operations and image ratio.

DESCRIPTION OF THE PREFERRED EMBODIMENTS

Hereinafter. the preferred embodiments of the present invention will be described with reference to the appended drawings.

Figure 1:
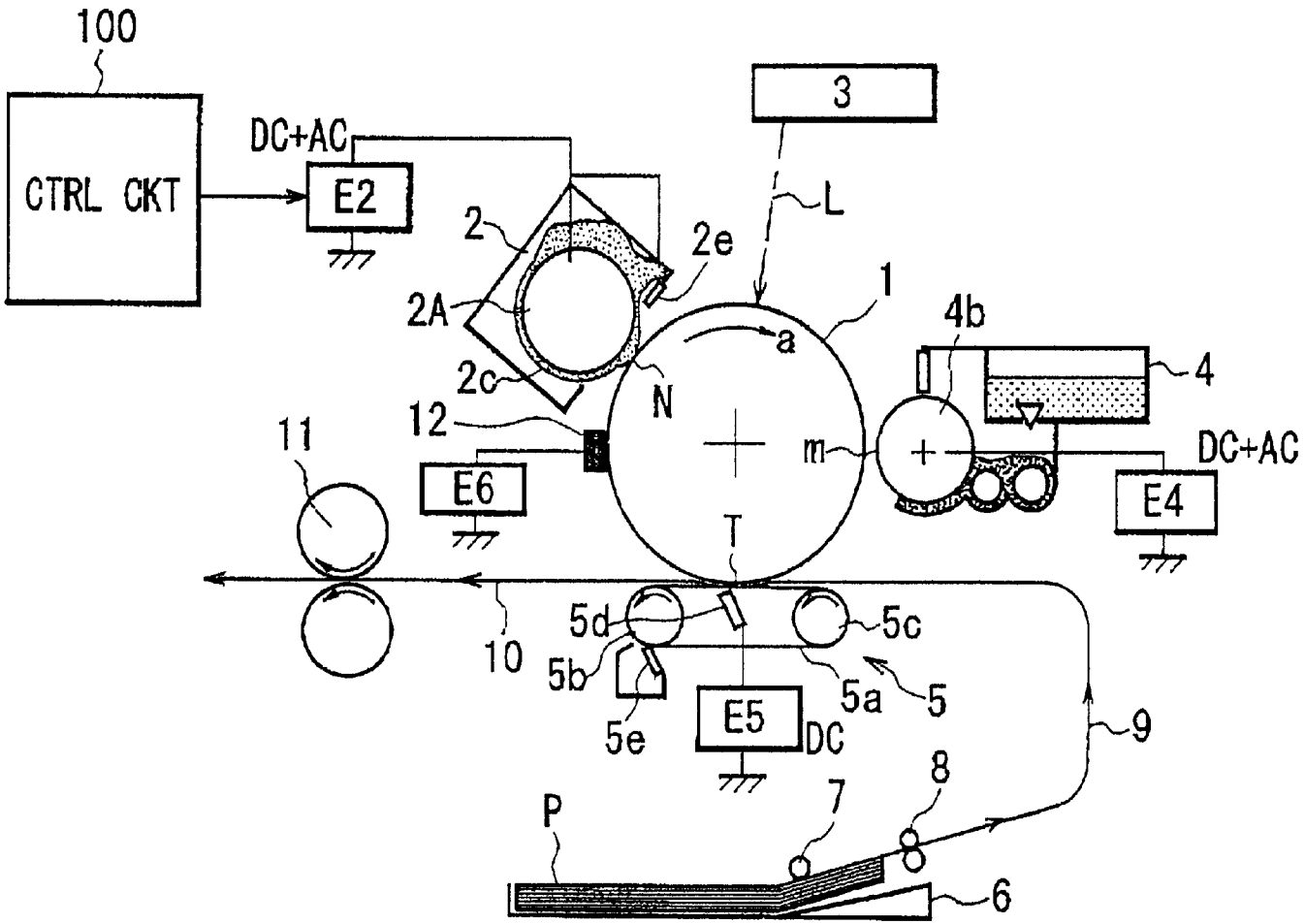
FIG. 1 is a schematic illustration of an image forming apparatus according to an embodiment of the present invention.

FIG. 1 is a schematic sectional view of the image forming apparatus in this embodiment, showing the general structure thereof. The image forming apparatus in this embodiment is a laser beam printer that employs a transfer type electrophotographic process, a charge injection type charging method, and a cleanerless process.

A referential code 1 designates an electrophotographic photoconductive member (which hereinafter will be referred to as photoconductive drum) in the form of a rotation drum. The photoconductive drum 1 in this embodiment is a negatively chargeable organic photoconductive member, into which electric charge can be directly injected (organic photoconductive member). It is rotationally driven in the clockwise direction a indicated by an arrow mark at a process speed (peripheral velocity) of 150 mm/sec A reference code 2 designates a contact type charging apparatus for uniformly charging the peripheral surface of the photoconductive film 1 to predetermined polarity and potential level. In this embodiment, it is a magnetic brush based charging apparatus. As the photoconductive drum 1 rotates, electric charge is injected into the photoconductive drum 1 by this magnetic brush based charging apparatus. As a result, the peripheral surface of the photoconductive drum 1 is uniformly charged to approximately −700 V.

Designated by a referential code 3 is an image data exposing means (exposing apparatus), which in this embodiment is a laser beam scanner. This laser beam scanner 3 comprises a semiconductor laser, a polygon mirror, an f-θ lens, and the like It projects a beam of laser light L (laser beam) modulated with sequential electrical digital image signals reflecting the image data of an intended image, which are inputted from an unshown host apparatus, for example, an image reader equipped with a photoelectric transducer such as a CCD, a computer, a word processor, and the like. The laser beam L is oscillated in a manner to scan (expose) the uniformly charged peripheral surface of the photoconductive drum 1. As a result, the electrical charge on the peripheral surface of the rotating photoconductive drum 1 is selectively removed. Consequently, an electrostatic latent image in accordance with the image data of the intended image is formed on the peripheral surface of the photoconductive drum 1.

A referential code 4 designates a developing apparatus, which in this embodiment employs a contact type developing method which uses two-component developer. The two component developer in this embodiment is a mixture of spherical toner particles manufactured by polymerization, and magnetic carrier particles. The spherical toner particles used by this developing apparatus are superior in mold release characteristic, and therefore, are small in the amount by which they remain on the peripheral surface of the photoconductive drum 1 after image transfer. This developing apparatus 4 develops in reverse an electrostatic latent image on the peripheral surface of the photoconductive drum 1, into a toner image.

A referential code 5 designates a transferring apparatus disposed below the photoconductive drum 1. The transferring apparatus in this embodiment is of a transfer belt type. A referential code 5*a* designates an endless transfer belt (for example, 75 μm thick polyimide belt), which is wrapped around a driver roller 5*b* and a follower roller 5*c*, being stretched between the two rollers. It is rotated in the same direction as the photoconductive drum 1 at approximately the same peripheral velocity as the photoconductive drum 1. A referential code 5*d* designates an electrically conductive blade disposed within the loop of the transfer belt 5*a*. The blade 5*d* is pressed against the bottom side of the photoconductive drum 1 with the interposition of the portion of the transfer belt 5*a*, correspondent to the top side of the belt loop, so that a transfer nip T is formed between the bottom side of the photoconductive drum 1 and the top side of the transfer belt 5*a*.

Designated by a referential code 6 is a sheet feeder cassette, in which certain pieces of transfer medium such as paper are stored in layers. As a sheet feeder roller 7 is driven, the pieces of transfer medium within the sheet feeder cassette 6 are separated one by one; and are conveyed to the transfer nip T between the rotating photoconductive drum 1 and the transfer belt 5*a* of the transferring apparatus 5, through a sheet path 9 inclusive of a pair of conveyer rollers 8 and the like, with predetermined timing.

As each piece of transfer medium P is fed into the transfer nip T, it is conveyed through the nip T, while being pinched between the photoconductive drum 1 and transfer belt 5*a*. While the piece of transfer medium P is conveyed through the transfer nip T, a predetermined transfer bias is applied to the aforementioned electrically conductive blade 5*d* from a transfer bias application power source E5. As a result, the transfer medium piece P is charged to the polarity opposite to that of the toner particles, from the back side of the transfer medium piece P. Consequently, the toner image on the peripheral surface of the rotating photoconductive drum 1 is electrostatically transferred onto the front side of the transfer medium piece P, gradually starting from the leading end of the toner image (transfer medium piece) toward the trailing end, while the transfer medium piece P is passing through the transfer nip T After the transfer medium piece P passes through the transfer nip T, in which it receives the toner image, it is gradually separated from the rotating photoconductive drum 1, also starting from the leading end toward the trailing end, is passed through the sheet path 10, and is introduced into a fixing apparatus 11 (for example, a thermal roller type fixing apparatus), in which the toner image is permanently fixed to the transfer medium piece P. Thereafter, the transfer medium piece P is discharged from the image forging apparatus.

The printer in this embodiment employs a cleanerless process. In other words, it does not have a cleaner dedicated to removing the transfer residual toner particles, that is, the toner particles remaining on the peripheral surface of the rotating photoconductive drum 1, without being transferred onto the transfer medium piece P in the transfer nip T. As will be described later, as the photoconductive drum 1 is further rotated, the transfer residual toner particles reach the magnetic brush type charging apparatus 2, and are temporarily recovered by the magnetic brush portion, as a contact type charging member, of the magnetic brush type charging device 2A, which is disposed in contact with the photoconductive drum 1; after being recovered by the magnetic brush portion, the transferred residual toner particles are expelled back onto the peripheral surface of the photoconductive drum 1, being eventually recovered by the developing apparatus 4. Then, the photoconductive drum 1 is repeatedly used for image formation.

A referential code 12 designates an electrically conductive auxiliary brush, which is disposed between the transferring apparatus 5 and magnetic brush type charging apparatus, in contact with the photoconductive drum 1. To the auxiliary brush 12, AC bias, DC bias which is opposite in polarity to the photoconductive drum 1, or a combination of AC bias, and DC bias which is opposite in polarity to the photoconductive drum 1, is applied from a power source E6. The auxiliary brush 12 evens the electrical charge on the peripheral surface of the photoconductive drum 1, in terms of potential level, immediately before the photoconductive drum 1 is charged by the magnetic brush type charging apparatus, and at the same time, rids the transfer residual toner particles of electrical charge of charges them to the polarity opposite to that of the photoconductive drum 1, making it easier for them to be recovered by the magnetic brush portion of the magnetic brush type charging apparatus.

Figure 2:
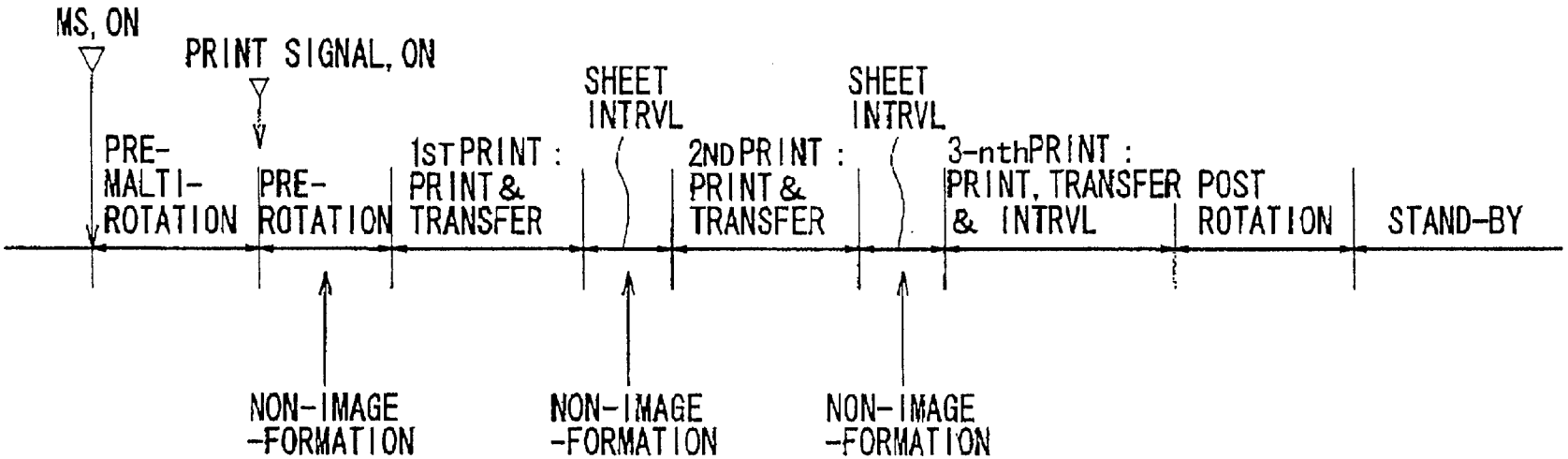
FIG. 2 is an operation sequence diagram of the image forming apparatus.

A referential code 100 designates a control circuit, which controls the overall operation of the printer, following a predetermined sequence (2) Printer Operation Sequence FIG. 2 shows an operational sequence for the above-described printer.

a. Multiple pre-rotation process: this is a startup process (startup process, warmup process), in which the main power switch is turned on to drive the main motor of the printer so that the photoconductive drum 1 is rotationally driven, and also to prepare predetermined processing devices for image formation.

b. Pre-rotation process: that is a process in which a pre-printing operation is carried out It is carried out following the multiple pre-rotation process as a print signal is inputted during the multiple pre-rotation period When no print signal is inputted during the multiple pre-rotation process, the driving of the main motor is temporarily stopped after the completion of the multiple pre-rotation process, and the printer is kept on standby until a print signal is inputted. As a print signal is inputted, the pre-rotation process is carried out.

c. Printing process (image forming process): this is a process carried out following the completion of the pre-rotation process. It is a process in which an image (toner image) is formed on the peripheral surface of the rotating photoconductive drum 1; the toner image is transferred onto transfer medium; the toner image is fixed to the transfer medium by a fixing means; and the transfer medium is discharged from the printer.

In the continuous printing mode, the above-described printing process is repeated the number of times equal to the present number of copies.

d. Sheet interval process: there is a process carried out while no recording paper is passed through the transfer nip, that is, during the intervals from the moment the trailing end of a piece of transfer medium passes the transfer nip to the moment the leading end of the next piece of transfer medium reaches the transfer nip, in the continuous printing mode.

In this process, while a given point of the peripheral surface fo the rotating photoconductive drum 1, which is going to pass through the transfer nip as the photoconductive drum 1 rotates, is passing through the charging nip, the AC component of the charge bias is not applied, so that those transferred residual toner particles, which are in the magnetic brush of the magnetic brush type charging apparatus after being temporarily recovered into the magnetic brush, are expelled back onto the rotating photoconductive drum 1.

e. Post-rotation process: this is a process which is carried out after the last copy is formed in the printing process, and in which the driving of the main motor is continued for a period of time to rotationally drive the photoconductive drum 1, and to carry out predetermine operations.

Also in this process, the AC component of the charge bias is not applied, as in the sheet interval process, so that those transfer residual toner particles, which are in the magnetic brush of the magnetic brush type charging apparatus after being temporarily recovered into the magnetic brush, are expelled back onto the rotating photoconductive drum 1.

f. Standby: after the completion of the predetermined post-rotation process, the driving of the main motor is stopped to stop rotationally driving the photoconductive drum 1, and the printer is kept on standby until a print signal is again inputted.

When an image forming operation is for producing only a single copy, the printer is put through the post-rotation process after the production of the single copy. Thereafter, the printer is kept on standby.

As a print start signal is inputted while the printer is on standby, the printer begins to carry out the pre-rotation process.

The printing process (c) is the actual image forming process, and the multiple rotation process (a), a pre-rotation process (b), sheet interval process (d), and post-rotation process (e), are the processes in which no image is formed.

Figure 3:
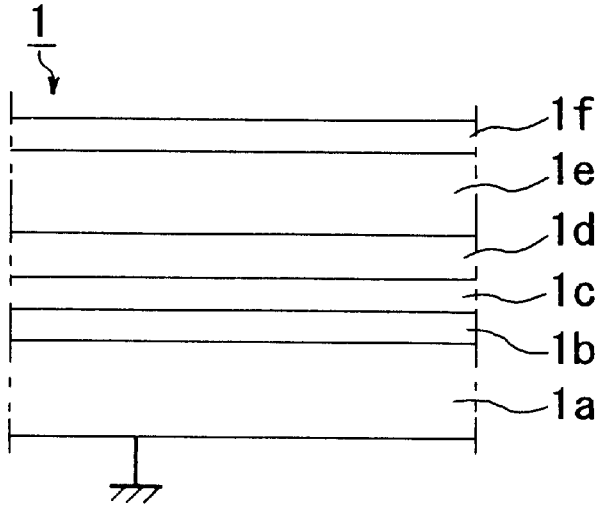
FIG. 3 is a schematic illustration of layers of a photosensitive member.

(3) Photoconductive Drum (FIG. 3)

As described above, the photoconductive drum 1 in this embodiment is an organic photoconductive member which can be negatively charged by charge injection, and comprises an aluminum drum 1*a* (base member) with a diameter of 30 mm, and five functional layers 1*b*–1*f*, coated in layers on the peripheral surface of the base member la in the listed order First layer 1*b*: this is an approximately 20 $\mu$m thick, electrically conductive, undercoat layer provided for rectifying the defects of the aluminum base member, and for preventing the moire caused by the reflection of the exposure laser beam.

Second layer 1*c*: this is a positive charge injection prevention layer for preventing the positive charge injected from the aluminum base drum 1*a* from canceling the negative charge given to the peripheral surface of the photoconductive member, and is an approximately 1 μm thick medium resistance layer formed of methoxy-methyl-nylon, the electrical resistance of which has been adjusted to approximately $10^6$ ohm.cm with the use of Amilan resin.

Third layer 1*d*: this is a charge transfer layer It is approximately 0.3 μm thick and is formed of a material concocted by dispersing diazoic pigment in a resinous substance. It generates charge couples comprising negative and positive charges as it is exposed to the laser beam.

Fourth layer 1*e*: this is a charge transfer layer. It is formed of a material concocted by dispersing hydrazine in polycarbonate resin. It is a P-type semiconductive layer Therefore, the negative charge given to the peripheral surface of the photoconductive member is not allowed to pass through this layer; in other words, only the positive charge generated in the charge generation layer 1*d* is allowed to transfer to the peripheral surface of the photoconductive member Fifth layer 1*f*: this is a charge injection layer. It is an approximately 3 μm thick coated layer of a material concocted by dispersing ultramicroscopic particles of tin oxide ($SnO_2$) which are 0.03 μm in diameter, and the electrical resistance of which has been reduced (rendered electrically conductive) by doping it with antimony as electrically conductive transparent filler, in photo-curable acrylic resin as binder, by 70% in weight. The electrical resistance of this charge injection layer 1*f* needs to be in a range of $1\times10^{10}$–$1\times10^{14}$ ohm.cm, in which satisfactory charging performance is realized, and also in which an image which looks as if it is flowing is not produced. In this embodiment, a photoconductive drum, the surface electrical resistance of which is $1\times10^{11}$ ohm.cm was employed as the photoconductive drum 1.

Figure 4:
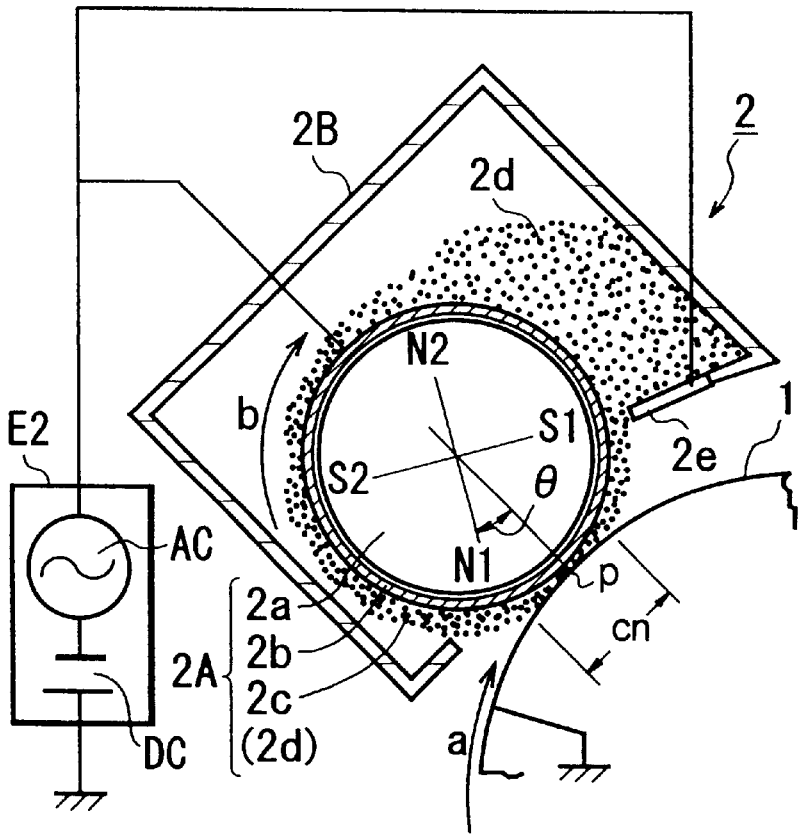
FIG. 4 is an enlarged schematic cross-sectional view of a magnetic brush charging apparatus.
Figure 5:
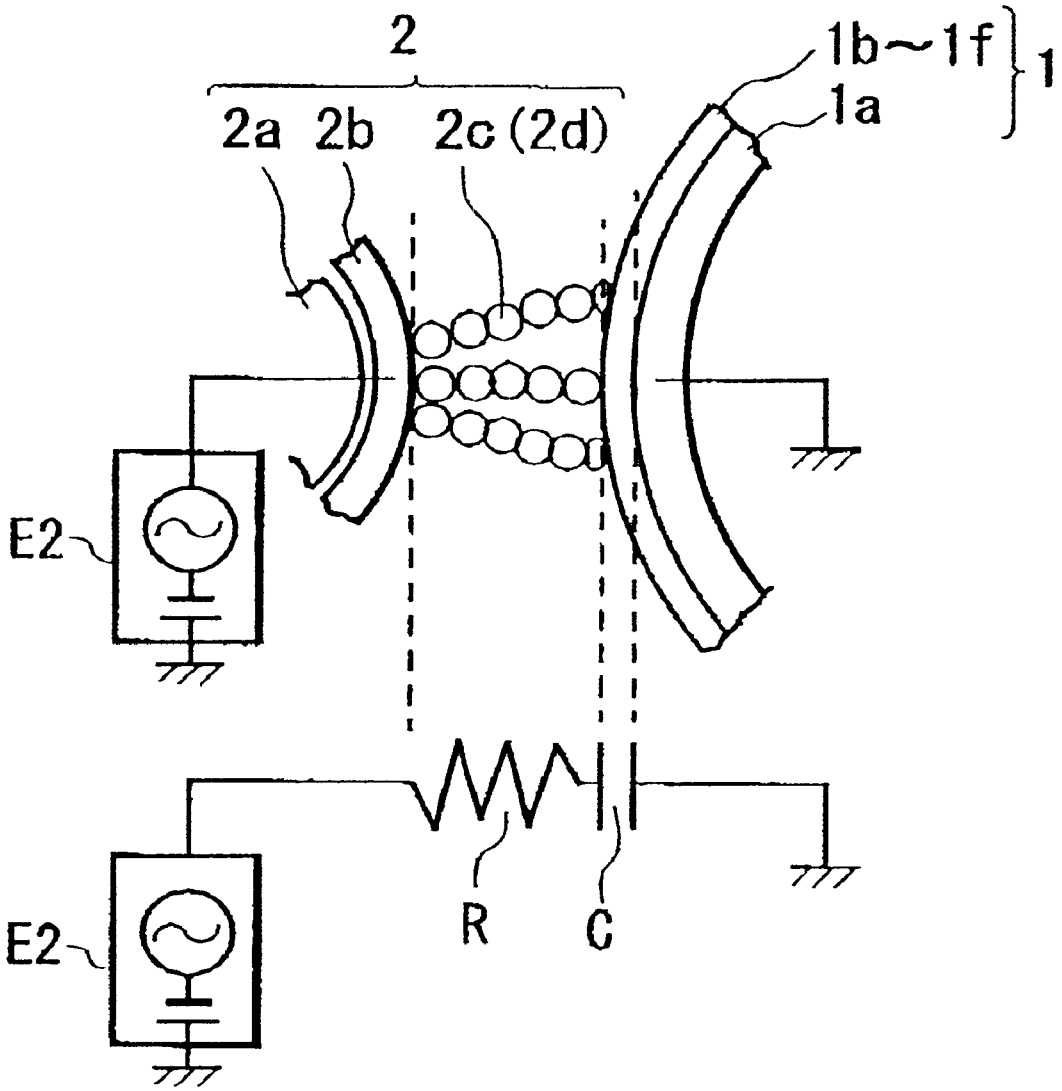
FIG. 5 is an equivalent circuit diagram of a charging circuit.
Figure 6:
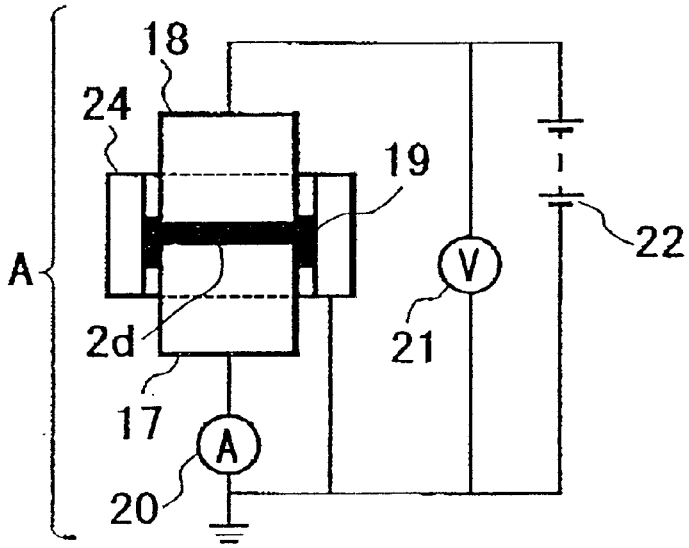
FIG. 6 is an illustration of a measuring manner of an electric resistance value (volume resistivity) of magnetic particles (charged carrier)

(4) Magnetic Brush Type Charging Apparatus 2 (FIGS. 4–6)

FIG. 4 is an enlarged schematic sectional view of the magnetic brush type charging apparatus 2. The magnetic brush type charging apparatus 2 in this embodiment roughly comprises: a magnetic brush type charging member 2A (magnetic brush type charging device); a housing 2B in which the magnetic brush type charging device 2A and electrically conductive magnetic particles 2*d* (charge carrier particles) are stored; a charge bias application power source E2 for the magnetic brush type charging device 2A; and the like.

The magnetic brush type charging device 2A in this embodiment is of a rotational sleeve type, and comprises: a magnetic roll 2*a*; a nonmagnetic stainless steel sleeve 2*b* (which sometimes is referred to as electrode sleeve, electrically conductive sleeve, charge sleeve, or the like) fitted around the magnetic roll 2*a*; and a magnetic brush portion 2*c*, that is, a layer of magnetic particles 2*d* magnetically held to the peripheral surface of the sleeve 2*b* by the magnetic force of the magnetic roll 2*a* within the sleeve 2*b*.

The magnetic roll 2*a* is nonrotational member, being stationarily disposed. The sleeve 2*b* is rotationally driven around this magnet roll 2*a* in the direction indicated by an arrow mark b at a predetermined peripheral velocity, which in this embodiment is 225 mm/sec by an unshown driving system. The sleeve 2*b* is disposed so that an approximately 500 μm wide gap is maintained between the sleeve 2*b* and photoconductive drum 1 with the use of spacer rings or the like .

A referential code 2*e* designates a blade for regulating the thickness of the magnetic brush layer. The blade 2*e* is formed of nonmagnetic stainless steel, and is attached to the container 2B (housing). The blade 2*b* is disposed so that it holds a gap of 900 μm from the peripheral surface of the sleeve 2*b*. It is electrically connected to sleeve 2*b*. Therefore, the magnetic brush type charging device 2A as a contact type charging member, and the blade 2*e* which is a piece of metallic plate, are equal to each other in electrical potential.

A certain amount of the magnetic particles 2*d* in the container 2B are held, as the magnetic brush portion 2*c*, to the peripheral surface of the sleeve 2*b* by being magnetically confined by the magnetic force from the magnetic roll 2*a* within the sleeve 2*b*. As the sleeve 2*b* is rotationally. driven, the magnetic brush portion 2*c* rotates with the sleeve 2*b* in the same direction. During this movement of the magnetic brush portion 2*c*, it is smoothed by the blade 2*e*, to a predetermined thickness, which is greater than the gap between the peripheral surfaces of the sleeve 2*b* and photoconductive drum 1, in the area in which the two surfaces oppose each other. Therefore, the magnetic brush portion 2*c* contacts the peripheral surface of the photoconductive drum 1, forming a nip against the peripheral surface of the photoconductive drum 1, in the area in which the two surfaces oppose each other. This nip is the charging nip cn. Thus, in the charging nip cn, the rotating photoconductive drum 1 is rubbed by the magnetic brush portion 2*c* which rotates following the rotation of the sleeve 2*b* of the magnetic brush type charging device 2A. In this case, the direction in which the peripheral surface of the photoconductive drum 1 moves in the charging nip cn is opposite to the direction in which the magnetic brush portion 2*c* moves in the charging nip cn, making the velocities of the peripheral surfaces of the photoconductive drum 1 and the magnetic brush portion 2*c* relative to each other substantially faster than when they are made to move in the same direction.

To the sleeve 2*b* and magnetic brush layer thickness regulating blade 2*e*. predetermined bias is applied from the power source E2.

Thus, as the predetermined charge bias is applied to the sleeve 2*b* of the magnetic brush type charging device 2A from the power source E2 while the photoconductive drum 1 and the sleeve 2*b* of the magnetic brush type charging device 2A are rotationally driven, electrical charge is injected into the peripheral surface of the photoconductive drum 1. As a result, the peripheral surface of the photoconductive drum 1 is uniformly changed to predetermined polarity and potential level; the photoconductive drum 1 is electrically charged with the use of an injection type charging method (contact type charging method).

Regarding the magnetic roll 2*a*, it is stationarily disposed in the sleeve 2*b* so that the magnetic pole N1 (primary pole), which is approximately 900 G in magnitude, is positioned 10 to 20 deg., in terms of the circumferential direction of the sleeve 2*b*, away in the direction opposite to the rotational direction of the photoconductive drum 1, from a point p, at which the distance between the photoconductive drum 1 and magnetic brush portion 2*c* is smallest.

The position of the primary pole N1 is desired to be such that the angle θ from the above-described point p at which the distance between the sleeve 2*b* and photoconductive drum 1 is smallest, to the primary pole N1, in terms of the direction opposite to the rotational direction of the photoconductive drum 1, falls in a range of 10 to 20 deg., preferably, 0 to 15 deg. If the position is outside the downstream end of this range, the magnetic particles are attached to the area of the peripheral surface of the sleeve 2*b*, correspondent to the position of the primary pole N1, being likely to collect on the downstream side of the charging nip cn in terms of the rotational direction of the photoconductive drum 1. On the other hand, if the position is outside the upstream end of this range, the magnetic particles are not efficiently conveyed, being likely to collect after passing through the charging nip cn.

If none of the magnetic poles of the magnetic roll 2*a* is within the range of the charging nip cn, the magnetic force which acts in a manner to hold the magnetic particles to the peripheral surface of the sleeve 2*b* is weaker, and therefore, the magnetic particles are more likely to adhere to the photoconductive drum 1, which is obvious.

The charging nip cn mentioned here corresponds to the area in which the magnetic particles of the magnetic brush portion 2*c* are in contact with the photoconductive drum 1 during the charging of the photoconductive drum 1. In this embodiment, the primary magnetic pole N1 is positioned 10 deg. in the upstream direction from the point p.

The charge bias is applied to the sleeve 2*b* and regulating blade 2*e* by the power source E2. In this embodiment, a combination of DC and AC voltages is used as the charge bias.

In the charging nip cn, as the peripheral surface of the photoconductive drum 1 is rubbed by the magnetic brush portion 2*c* of the magnetic brush type charging device 2A while the charge bias is applied to the magnetic brush type charging device 2A, electrical charge is given to the peripheral surface of the photoconductive drum 1 from the magnetic particles in the magnetic brush portion 2*c*. As a result, the peripheral surface of the photoconductive drum 1 is uniformly charged to predetermined polarity and potential level; it is uniformly charged by a contact type charging method.

As described above, in this embodiment, the outermost layer of the photoconductive drum 1 is the charge injection layer 1*f*. Therefore, the photoconductive drum 1 can be charged by directly injecting electrical charge into the photoconductive drum 1. In other words, the peripheral surface of the photoconductive drum 1 can be charged to a potential level virtually equal to the potential level of the DC component of the charge bias, that is, the combination of AC and DC voltages. It is likely that the greater the rotational velocity of the sleeve 2*b*, the more uniformly the photoconductive drum 1 is charged.

The circuit for directly injecting electrical charge from the magnetic brush type charging device 2A into the photoconductive drum 1 may be regarded as a circuit which connects in series a resistor R and a condenser C, as represented by the equivalent circuit in FIG. 5. In the case of a circuit such as the one in FIG. 5, the surface potential level Vd of the photoconductive drum 1 can be obtained using the following equation (1):

$$Vd=V0(1-\exp(T0/Cp.r)) \quad (1)$$

r: electrical resistance

Cp: electrostatic capacity of photoconductive drum

V0: applied voltage

T0: length of charging time (length of time it takes for a given point of the peripheral surface of the photoconductive drum 1 to pass through the charging nip cn.

In the charge bias, or the combination of DC and AC voltages, the potential level of the DC component is equal to the potential level to which the peripheral surface of the photoconductive drum 1 is to be charged In this embodiment, it is −700 V.

Regarding the AC component of the charge bias during image formation, its peak-to-peak voltage Vpp is desired to be no less than 100 V and no more than 2000 V, preferably no less than 300 V and no more than 1200 V. If the peak-to-peak voltage Vpp is less than the lower end of the above-described range, the AC component is weak in its performance regarding the degree of the uniformity with which the photoconductive drum 1 is charged, and also regarding the manner in which the potential level of the photoconductive drum 1 starts up. On the other hand, if it is no less than the higher end of the above-described range, it worsens the tendency of the magnetic particles to collect, and/or the tendency of the magnetic particles to adhere to the photoconductive drum 1.

In this embodiment, the peak-to-peak voltage Vpp is set to −700 V

The frequency of the AC component is desired to be no less than 100 Hz and no more than 5000 Hz, in particular, no less than 500 Hz and no more than 2000 Hz. If it is no more than the lower end of the above-described range, the AC component is ineffective in rectifying the adhesion of the magnetic particles to the photoconductive drum, improving the degree of uniformity with which the photoconductive drum 1 is charged, and improving the manner in which the potential level of the photoconductive drum 1 starts up. On the other hand, if it is no less than the high end of the above-described range, the AC component is also ineffective in the above-described functions.

The waveform of the AC component is desired to be rectangular, triangular, sinusoidal, or the like.

In this embodiment, particles obtained by reducing the particles obtained by sintering ferrite were used as the magnetic particles 2*d* which make up the magnetic brush portion 2*c*. However, particles obtained by pulverizing the kneaded mixture of resin and ferrite powder, the preceding particles, the electrical resistance of which has been adjusted by the mixing of electrically conductive particles such as carbon particles, and also the preceding particles, which have been given a certain surface treatment, can be employed with the same effects.

Not only must the magnetic particles 2*d* in the magnetic brush portion 2*c* be able to play the role of improving the efficiency with which electrical charge is injected into the traps in the peripheral surface of the photoconductive drum 1, but also the role of preventing the phenomenon that the charging member and photoconductive drum are short-circuited by the concentration of the charging current to the defects such as pinholes in the surface of the photoconductive drum 1.

Therefore, the electrical resistance of the magnetic brush type charging device 2A is desired to be in a range of $1\times10^4$ ohm–$1\times10^9$ ohm, in particular, $1\times10^4$ ohm–$1\times10^7$ ohm. If the electrical resistance of the magnetic brush type charging device 2A is no more than $1\times10^4$ ohm, pinhole leakage is more likely to occur, whereas if it is no less than $1\times10^9$ ohm, it is difficult for an electrical charge to be efficiently injected. In order to keep the electrical resistance of the magnetic brush type charging device 2A within the above-described range, the volumetric resistivity of the magnetic particles 2*d* is desired to be in a range of $1\times10^4$ ohm.cm–$1\times10^9$ ohm.cm, in particular, $1\times10^4$ ohm.cm–$1\times10^7$ ohm.cm.

In this embodiment, the electrical resistance of the magnetic brush type charging device 2A was $1\times10^6$ ohm, and the surface potential level of the photoconductive drum 1 became 700 V as a DC voltage of −700 V was applied as the DC component of the charge bias.

The volumetric resistivity value of the magnetic particles 2*d* was measured using the procedure shown in FIG. 6. That is, the magnetic particles 2*d* were filled in a cell A, with a primary electrode 17 and a top electrode 18 placed in contact with the magnetic particles 2*d*. Then, the current, which flowed between the two electrodes 17 and 18 while voltage was applied between the two electrodes 17 and 18 from a constant voltage power source 22, was measured with the use of an ammeter 20. Then, the volumetric resistivity value of the magnetic particles 2*d* was obtained from the measured current value. In FIG. 6, a referential code 19 designates an insulator; 21, a volumeter; and a referential code 24 designates a guide ring.

As for the condition under which the volumetric resistivity value of the magnetic particles 2*d* was measured, the temperature and humidity were 23° C. and 65%, respectively, and the size of the contact area between the packed magnetic particles 2*d* and cell A was 2 $cm^2$. The thickness of the packed magnetic particle 2*d* was 1 mm, and the load applied to the top electrode 18 was 98 N (10 kg). The applied voltage was 100 V.

From the viewpoint of preventing charging performance from being reduced by the surface contamination of the magnetic particles 2*d*, and also preventing the magnetic particles from adhering to the peripheral surface of the photoconductive drum 1, it is desired that the average particle diameter of the magnetic particles 2*d*, and the peak of the particle size distribution curve, are within a range of 5–100 $\mu$m.

The average particle diameter of the magnetic particles 2*d* is represented by the average horizontal maximum chord length thereof, which is an arithmetical average of the actually measured, with the use of a microscope, horizontal maximum chord lengths of the randomly selected 3000 or more magnetic particles.

Figure 7:
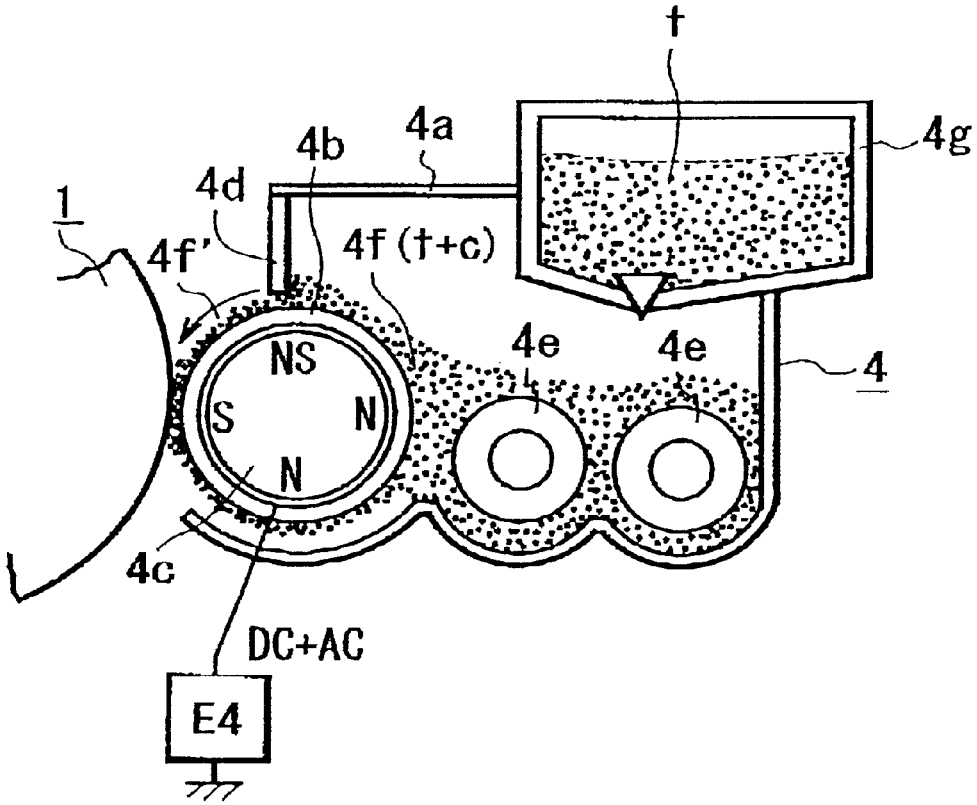
FIG. 7 is an enlargement schematic cross-sectional view of a developing device.

(5) Developing Apparatus (FIG. 7)

Generally, the methods for developing an electrostatic latent image with the use of toner can be roughly divided into four groups a–d.

a. Single-component noncontact developing method: an electrostatic latent image is developed by the toner conveyed by being coated in a layer on a sleeve, and there is no direct contact between the toner layer on the sleeve and the photoconductive member. When nonmagnetic toner is used, it is coated on the peripheral surface of the sleeve using a blade or the like, whereas when magnetic toner is used, it is coated on the peripheral surface of the sleeve by magnetic force.

b. Single-component contact developing method: an electrostatic latent image is developed by placing the toner layer coated on a sleeve as described above, in contact with the peripheral surface of the photoconductive member.

c. Two-component contact developing method: a mixture of toner particles and magnetic carrier particles is used as developer, which is borne in a layer on the peripheral surface of the sleeve by magnetic force. An electrostatic latent image is developed by placing the developer layer on the peripheral surface of the sleeve, in contact with the photoconductive member.

d. Two-component noncontact developing method: an electrostatic latent image is developed using the above-mentioned two-component developer, without placing the developer layer in contact with the photoconductive member.

Of the four developing methods described above, the two-component contact developing method (c) is widely in use, from the standpoint of image quality improvement and charging performance stability.

FIG. 7 is an enlarged schematic sectional view of the developing apparatus 4 in this embodiment. The developing apparatus 4 in this embodiment is a reversal type developing apparatus which employs a magnetic brush type contact developing method which uses two-component developer. In other words, the developer used by the developing apparatus 4 in this embodiment is a mixture of spherical magnetic toner particles, which are manufactured by polymerization, and is superior in mold release characteristic, and magnetic carrier particles (magnetic developer carrier particles; developer carrier particles). The developer is held in a layer (magnetic brush layer) to a developer bearing member (developing member; developing device) by magnetic force, and is conveyed to the development station, in which it is placed in contact with the peripheral surface of the photoconductive drum to a develop an electrostatic latent image into a toner image.

A referential code 4*a* designates a developer container; 4*b*, a development sleeve as a developer carrier; 4*c*, a magnet (magnetic roll) as a magnetic field generating means stationarily disposed in the hollow of the development sleeve 4*b*; 4*d*, a developer layer thickness regulated blade for forming a thin layer of developer on the peripheral surface of the development sleeve 4*b*; 4*e*, a developer stirring/conveying screw; and a referential code 4*f* designates the two-component developer stored in the developer container 4*a*. As described before, the two-component developer is a mixture of nonmagnetic toner t and developer carrier c.

The development sleeve 4*b* is disposed so that at least during development, the smallest distance (gap) between the peripheral surfaces of the development sleeve 4*b* and photoconductive drum 1 is kept at approximately 500 $\mu$m, and also so that the thin layer 4*f*″ (magnetic brush layer) of the developer, borne on the peripheral surface of the development sleeve 4*b*, remains in contact with the peripheral surface of the photoconductive drum 1. The contact nip m between the thin layer 4*f*′ (magnetic brush layer) of the developer, and the peripheral surface of the photoconductive drum 1 constitutes the development area (development station).

The development sleeve 4*b* is rotated around the magnet 4*c* stationarily disposed within the development sleeve 4*b*, in the counterclockwise direction indicated by an arrow mark, at a predetermined peripheral velocity, and a layer of developer 4*f*(t+c), that is, a magnetic brush, is formed on the peripheral surface of the development sleeve 4*b* by the magnetic force from the stationary magnet 4*c*. The magnetic brush composed of the developer moves with the peripheral surface of the development sleeve 4*b* as the development sleeve 4*b* rotates, and as it moves with the peripheral surface of the development sleeve 4*b*, it is regulated in thickness by the blade 4*d*. Then, as the development sleeve 4*b* further rotates, it comes out, as the thin developer layer 4*f* (magnetic brush layer) with a predetermined thickness, from the developer container, and is conveyed to the development station, in which it contacts the peripheral surface of the photoconductive drum 1. Thereafter, it is returned to the developer container 4*a* by the further rotation of the development sleeve 4*b*.

To the development sleeve 4*b*, a predetermined development bias, which is a combination of DC and AC voltages, is applied from a development bias application power source E4. The development process in this embodiment was characterized in that when the difference between the potential level (700 V) of the photoconductive drum 1 and the potential level of the DC component of the development bias was no more than 200 V, fog was generated, whereas when it was no less than 350 V, the development carrier c adhered to the photoconductive drum 1. Therefore, the potential level of the DC component of the development bias was set to −400 V.

The toner content (toner ratio relative to developer carrier c) of the developer 4*f*(t+c) within the developer container 4*a* gradually falls as the toner is consumed for developing electrostatic latent images. The toner content of the developer 4*f* within the developer container 4*a* is detected by an unshown detecting means. As the toner content falls to the bottom end of a predetermined satisfactory toner content range, the developer container 4*a* is supplied with the toner t from a toner supplying portion 4*g* so that the toner content of the developer 4*f* within the developer container 4*a* always remains within the predetermined satisfactory toner content range.

(6) Cleanerless Process

The printer in this embodiment employs a cleanerless process. In other words, the transfer residual toner particles, that is, the toner particles remaining on the peripheral surface of the photoconductive drum 1 after the toner image on the photoconductive drum 1 is transferred onto a piece of transfer medium P, are passed by the auxiliary brush 12 and then, are carried to the charging nip cn between the photoconductive drum 1 and magnetic brush portion 2*c*. In the charging nip cn, the transfer residual toner particles are temporarily recovered by the magnetic brush type contact charging apparatus 2; more specifically, they are mixed into the magnetic brush portion 2*c* of the magnetic brush type contact charging apparatus 2.

The polarity of the transfer toner particles is affected by the electrical discharge which occurs when an image on the photoconductive drum 1 is transferred. Thus, more often than not, the transfer residual toner on the peripheral surface of the photoconductive drum 1 is a mixture of the negatively charged toner particles and positively charged toner particles. This mixture of negatively charged toner particles and positively charged toner particles is discharged, or rectified in polarity, that is, uniformly charged to the polarity opposite to the normal polarity, by the auxiliary brush 12 disposed in contact with the peripheral surface of the photoconductive drum 1, between the charging nip T and charging nip cn.

More specifically, to the auxiliary brush 12, AC bias, DC bias different in polarity from the charge bias, or a combination of AC bias and DC bias different in polarity from the charge bias, is applied from the power source E6. As a result, the surface charge of the photoconductive drum 1 is evened in potential level immediately before the photoconductive drum 1 is charged by the magnetic brush type charging apparatus 2, and at the same time, the transfer residual toner particles are discharged, or charged to the polarity opposite to that of the photoconductive drum 1, making it easier for the transfer residual toner particles to be recovered by the magnetic brush portion 2*c* of the magnetic brush type charging device 2A. Thereafter, the transfer residual toner particles reach the magnetic brush type charging device 2A, and are temporarily recovered by the magnetic brush portion 2*c* (mixed into magnetic brush portion).

The addition of AC voltage to the charge bias applied to the magnetic brush type charging device 2A generates an oscillatory electrical field between the magnetic brush type charging device 2A and the photoconductive drum 1, which improves the efficiency of this process of recovering the transfer residual toner into the magnetic brush portion 2*c* of the magnetic brush type charging device 2A.

After being taken into the magnetic brush portion 2*c*, all transfer residual toner particles are charged to negative polarity, and expelled back onto the peripheral surface of the photoconductive drum 1. After being expelled from the magnetic brush portion 2*c* onto the peripheral surface of the photoconductive drum 1, the transfer residual toner particles are evenly present across the peripheral surface of the photoconductive drum 1. In addition, the amount of the transfer residual toner particles is very small. Therefore, they do not significantly affect the following exposing process in an adverse manner. Further, no ghost, for which the transfer residual toner distribution pattern is responsible, occurs.

After being made uniform in polarity and expelled onto the photoconductive drum 1, the transfer residual toner particles reach the development station, in which they are recovered into the developing apparatus 4, that is, adhered to the development sleeve 4*b*, by the fog removal electrical field, at the same time as the latent image on the peripheral surface of the photoconductive drum 1 is developed. In other words, the transfer residual toner particles are recovered at the same time as the photoconductive drum 1 is cleaned.

When an intended image is longer, in terms of the rotational direction of the photoconductive drum 1, than the circumference of the photoconductive drum 1, this process of recovering the transfer residual toner particles at the same time and place as the latent image is developed, is carried out at the same time as the image formation process other than this process, that is, the charging, exposing, developing, transferring processes, and the like, are carried out.

With the provision of the above-described arrangement, the transfer residual toner particles are recovered into the developing apparatus 4, and are used for the following image formation cycles. Therefore, no waste toner is produced, eliminating the need for a waste toner bin, which is advantageous in terms of spatial efficiency. In other words, the present invention makes it possible to drastically reduce image forming apparatus size.

The usage of spherical toner particles, which are manufactured by polymerization and are superior in mold release characteristic, as the toner t of two-component developer, can reduce the amount by which transfer residual toner particles are generated. It also can improve the efficiency with which the transfer residual toner particles are removed into the developing apparatus 4 after they are expelled from the magnetic brush type charging device 2A. The employment of the developing apparatus 4 which uses a two-component contact developing method adds to the improvement of the efficiency with which the transfer residual toner particles are removed into the developing apparatus 4 after they are expelled from the magnetic brush type charging device 2A (7) Charging Device Cleaning Mode Generally, toner is relatively high in electrical resistance. Therefore, mixing toner particles into the magnetic brush portion 2*c* of the magnetic brush type charging device 2A increases the electrical resistance of the magnetic brush portion 2*c*, which in turn reduces the charging performance of the magnetic brush type charging apparatus 2. Thus, the performance of the charging apparatus 2 can be maintained at a satisfactory level by causing the magnetic brush portion 2*c* to aggressively expel the transfer residual toner particles while no image is formed, as the amount of toner particles in the magnetic brush portion 2*c* reaches a predetermined level (charging device cleaning mode).

At this time, the process of expelling toner particles while no image is formed, in a charging device cleaning mode, will be concisely described.

As toner particles mix into the magnetic brush portion 2*c* of the magnetic brush type charging device 2A, the electrical resistance of the magnetic brush portion 2*c* gradually increases, eventually preventing electrical charge from being transferred by a satisfactory amount in the charging nip N, Therefore, after passing through the charging nip, the potential level of a given point of the peripheral surface of the photoconductive member is lower than the potential level of the applied voltage. Hereinafter, the difference in potential level between the peripheral surface of the photoconductive member and the applied voltage will be represented by Δ V.

As the toner particles in the magnetic brush type charging device 2A are charged to the same polarity as the polarity of the charge of the photoconductive member, through their contact with the magnetic particles which make up the magnetic brush portion 2*c*, they are expelled from the magnetic brush portion 2*c* onto the peripheral surface of the photoconductive member by the electrical field generated by the potential level difference Δ V.

There have been known such methods as those disclosed in Japanese Laid-Open Patent Application 9-96949 and the like, which use the above-described phenomenon According to these methods, the electrical resistance of the magnetic brush portion 2*c* is prevented from increasing, by making the magnetic brush portion 2*c* aggressively expel the toner particles by increasing the potential level difference Δ V by not applying the AC component of the charge bias while no image is formed.

By expelling toner particles while no image is formed, that is, during a sheet interval, during the post-rotation immediately after an actual image forming operation, and/or the like periods, the amount of the toner particles within the magnetic brush portion 2*c* can be kept at no more than a predetermined level, for a long period of usage.

After being expelled onto the photoconductive drum 1 from the magnetic brush portion 2*c* while no image is formed, the toner particles are removed from the peripheral surface of the photoconductive drum 1 by being recovered by the developing apparatus, or transferred onto the surface of the transfer belt 5*a*, in the transferring nip T. If they are transferred onto the surface of the transfer belt 5*a*, the toner particles are removed therefrom by belt cleaner 5*e*.

(8) Copy Count, Image Ratio and Photoconductive Film Thickness

As described before, as the cumulative usage of the photoconductive drum increases, the surface layer of the photoconductive drum (photoconductive member) as an image bearing member reduces in thickness. As the thickness of the surface layer of the photoconductive member reduces, images with striped fog begin to be formed. The present invention is characterized in that in order to prevent the formation of the images with striped fog, the duration or frequency of the toner particle expelling process is modified according to the amount of the portion of the image bearing member which has been shaved away.

The amount of the portion of the image bearing member shaved away through usage can be estimated from at least one factor among cumulative copy count, cumulative image ratio, and cumulative developer consumption amount.

More concretely, images were formed at various image ratios, using the above-described forming apparatus, and the relationship between the amount by which the photoconductive member (charge injection layer) was shaved away, and the cumulative copy count, was tested. FIG. 8 shows the results of this test.

It is evident from FIGS. 8(*a*) and 8(*b*) that if image ratio is kept constant, the amount by which the photoconductive member is shaved away is proportional to the square of the cumulative copy count, and also it is evident from FIG. 8(*c*) that the amount by which the photoconductive member is shaved away is proportional to the cumulative image ratio.

Thus, in this embodiment, the shaved amount of the charge injection layer 1*f* of the photoconductive member is defined as the value obtained from the following equation:

$$\text{Shaved amount of charge injection layer} = 2\times(d\times n\times n+4{,}500{,}000{,}000)\mu\text{m} \quad (2)$$

d: average image ratio (which is calculated from video-count)

n: cumulative number of fed papers.

This shaved amount of the charge injection layer if is approximately calculated by a control circuit 100.

Figure 9:
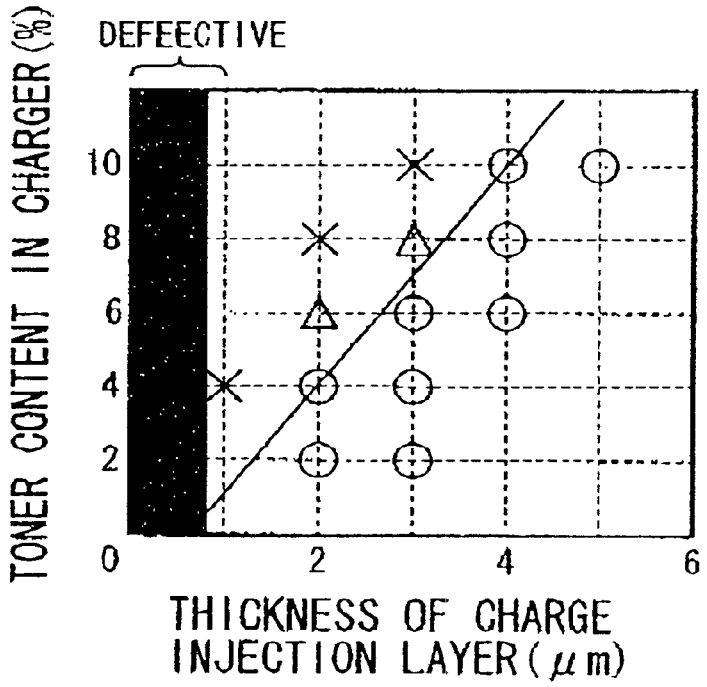
FIG. 9 shows occurrences of uniform fog in the form of stripes in relation to the charge injection layer and the toner constant in the charger.

FIG. 9 shows the results of the studies regarding the relationship between the thickness of the charge injection layer 1*f* of the photoconductive member and the presence (absence) of the striped fog, and the relationship between the toner content in the charging device 2A and the presence (absence) of the striped fog. It is evident from FIG. 9 that the thinner the charge injection layer 1*f* becomes, the lower the upper limit of the toner content within the charging device 2A at which the striped fog occurs becomes.

Figure 10:
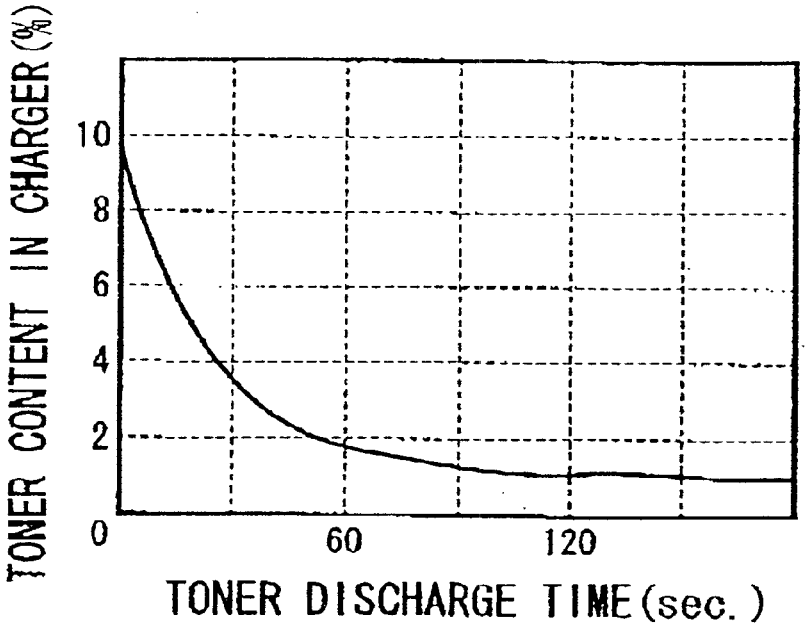
FIG. 10 shows a change of the toner content in the charger in relation to the discharging time.

On the other hand, FIG. 10 shows the changes of the toner content within the charging device 2A relative to the duration of the expelling time. It is evident from this result that the lower the toner content within the charging device is rendered, the longer the time required for the expelling becomes.

In this embodiment, the occurrence of the striped fog was prevented by carrying out an image forming operation only when the toner content value was within a range between the value of the upper limit of the toner content at which the striped fog begins to appear, and the value which is smaller by 1% than the value of the upper limit.

For the purpose, the length of time the toner within the charging device was to be expelled was set according to the thickness of the charge injection layer 1*f*. This relationship between the length of the toner expelling time and the different stages of the thickness of the charge injection layer 1*f* is shown in Table 1.

The data in this Table 1 was inputted in the control circuit 100, being set up as a control reference table.

TABLE 1

| CHARGE INJECTION LAYER (μ) | 1–2 | 2–3 | 3–4 | 4–5 | 5–6 |
|---|---|---|---|---|---|
| UPPER LIMIT OF TONER CONTENT (%) | 1 | 4 | 7 | 10 | 10 |
| EXPELLING TIME (sec) | 60 | 20 | 10 | 5 | 5 |

The toner content within the charging device 2A was obtained using the following method. First, the control circuit 100 calculated the amount of toner consumption based on the value of the video counter, and estimated the amount of the transfer residual toner particles which mixed into the developer within the charging device. As this estimated amount of the transfer residual toner particles which mixed into the developer within the charge device reached the upper limit to toner content value, the control circuit 100 interrupted the image formation and carried out the charging device cleaning mode; in other words, the toner particles were aggressively expelled from the charging device.

Figure 13:
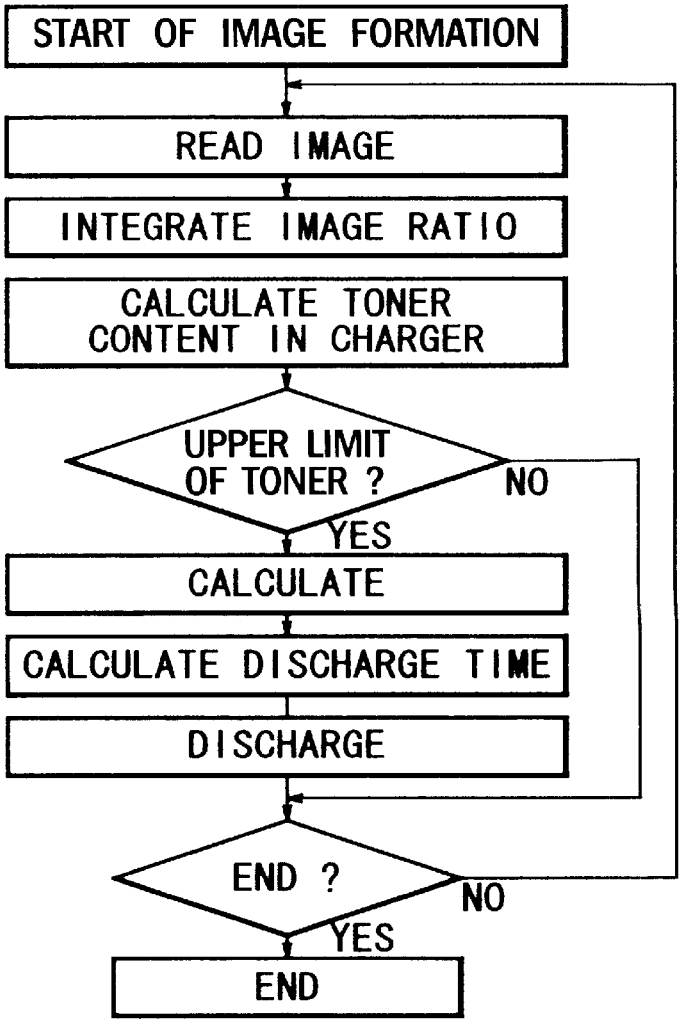
FIG. 13 is a flowchart of a charger cleaning control.

FIG. 13 is a flowchart for the charging device cleaning control.

The toner content in the charging device may be detected by a method for directly measuring the toner content in the charging device with the use of an inductance sensor or the like, in addition to the above-described method in which it is calculated based on the image ratio.

By carrying out the above-described toner expelling process, the occurrence of the striped fog could be prevented even after the thickness of the charge injection layer 1*f* of the photoconductive member became thin due to the shaving.

Further, the thinning of the layer of the photoconductive member resulting from the usage of the photoconductive member can be automatically detected or measured with the use of an electrical circuit along with the apparatus or method disclosed in Japanese Laid-Open Patent Applications 5-223513 and 8-220935, and the like, for example.

(9) Miscellaneous

1) The preceding embodiments of the present invention were described with reference to an injection type charging apparatus using a magnetic brush. However, the present invention is also applicable to various contact charging apparatuses other than an injection type charging apparatus using a magnetic brush.

In other words, the choice of a contact charging member as a contact charging means is not limited to the magnetic brush in the preceding embodiments. It may be an electrically conductive elastic roller, an electrically conductive elastic blade, a brush or brush roller formed of electrically conductive fibers, or the like. Further, a charging method which uses charging performance enhancement particles may be used.

2) The waveform of the alternating voltage (AC voltage) in charge bias, and the waveform of the alternating voltage (AC voltage) in development bias, are optional. They may be sinusoidal rectangular, triangular, or the like It may be such a rectangular waveform that is created by periodically turning on/off a DC power source. In other words, the waveform itself of the alternating voltage is not essential to the present invention; any bias may be used as the charge bias or development bias, as long as its voltage value periodically changes.

3) The choice of an image exposing means for forming an electrostatic latent image does not need to be limited to an exposing means which uses a scanning laser beam. It may be a digital exposing means such as an exposing means which uses an LED or the like, or an analog exposing means which uses a projection lens system or the like 4) The choice of an image bearing member as an object to be charged may be an electrostatically recordable dielectric member or the like. In such a case, the surface of an electrically recordable dielectric member or the like is uniformly charged (primary charge) to predetermined polarity and potential level, and is selectively discharged with the use of a discharging means such as an electron gun, to write an intended electrostatic latent image.

5) The selection of a developing means 4 is optional. It may be a developing means which normally develops a latent image.

6) The transfer medium may be an intermediary transferring member in the form of an endless belt or a drum.

While the invention has been described with reference to the structures disclosed herein, it is not confined to the details set forth and this application is intended to cover such modifications or changes as may come within the purposes of the improvements or the scope of the following claims.

What is claimed is:

1. An image forming apparatus, comprising:

an image bearing member;

charging means for electrically charging said image bearing member;

electrostatic image forming means for forming an electrostatic image by selectively discharging said image bearing member charged by said charging means;

developing means for developing the electrostatic image formed on said image bearing member into a toner image with toner;

transfer means for transferring the toner image from said image bearing member onto a transfer material, wherein said charging means is capable of collecting residual toner from said image bearing member after an image transfer operation is performed;

electric field forming means for forming an electric field between said charging means and said image bearing member to transfer the residual toner from said charging means to said image bearing member; and control means for controlling a length of time during which said electric field forming means forms the electric field, wherein said control means controls the length of time substantially in accordance with wear of a surface of said image bearing member.

2. An apparatus according to claim 1, wherein said charging means includes charging particles contactable to said image bearing member.

3. An apparatus according to claim 1, wherein said charging means charges said image bearing member by injecting an electric charge into said image bearing member.

4. An apparatus according to claim 1, wherein said image bearing member includes a charge injection layer.

5. An apparatus according to claim 1, wherein the length of time increases with a degree of wear of the surface of said image bearing member.

6. An apparatus according to claim 1, wherein said control means controls the length of time on the basis of at least one of a number of image formations, an image ratio, and an amount of toner consumption.

* * * * *

UNITED STATES PATENT AND TRADEMARK OFFICE

CERTIFICATE OF CORRECTION

PATENT NO. : 6,591,072 B2
DATED : July 8, 2003
INVENTOR(S) : Kouichi Hashimoto et al.

Figure 11B:
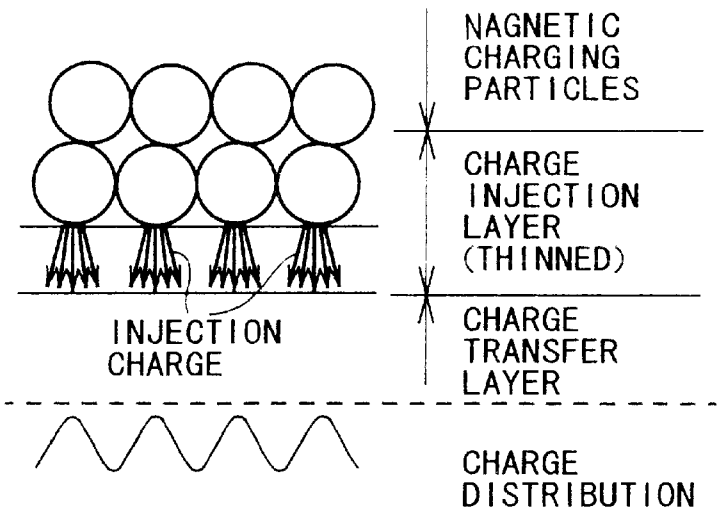
FIGS. 11(*a*) and 11(*b*) is an illustration of charge movement and thicknesses of the charge injection layer.
Figure 11A:
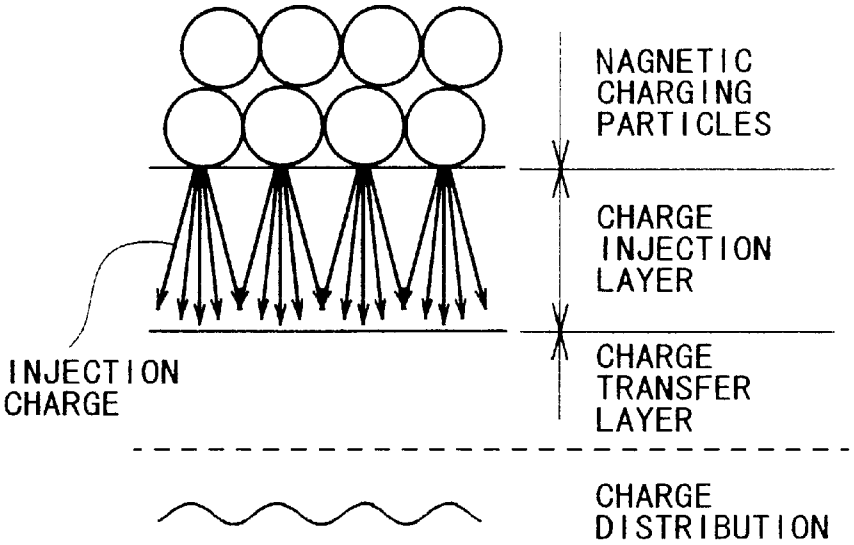
Figure 12:
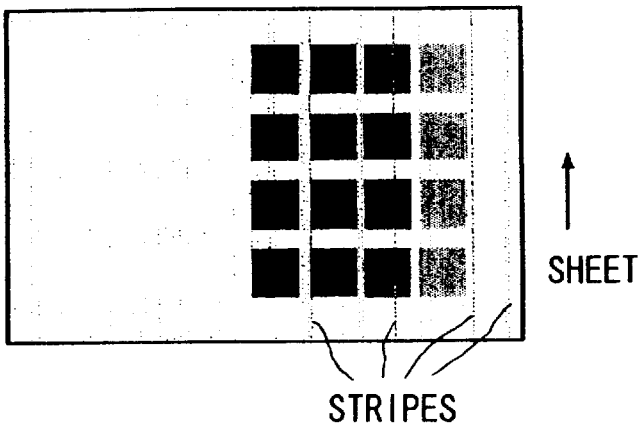
FIG. 12 is a sample of an image having the fog in the form of stripes.

It is certified that error appears in the above-identified patent and that said Letters Patent is hereby corrected as shown below:

Drawings,
Fig. 9, “DEFEECTIVE” should read -- DEFECTIVE --; and
Figs. 11(a) and 11(b), “NAGNETIC” should read -- MAGNETIC --.

Column 1,
Line 35, “collecting” should read -- collected --.

Column 2,
Line 17, “shown the” should read -- shown in --; and
Line 40, “operations” should read -- operation. --.

Column 3,
Line 16, “(charged carrier)” should read -- (charged carrier). --;
Line 20, “illustrates” should read -- illustrate --;
Line 36, “Hereinafter.” should read -- Hereinafter, --; and
Line 55, “150 mm/sec” should read -- 150 mm/sec. --.

Column 4,
Line 2, “like” should read -- like. --; and
Line 18, “uses” should read -- uses a --.

Column 5,
Line 3, “nip T” should read -- nip T. --;
Line 44, “of charges them” should be deleted;
Line 60, “that” should read -- this --;
Line 61, “out” should read -- out. --; and
Line 63, “period” should read -- period. --.

Column 6,
Line 14, “there” should read -- this --;
Line 15, “while” should read -- when --;
Line 20, “fo” should read -- of --;
Line 61, “member ℓa” should read -- member 1*a* --; and
Line 62, “order” should read -- order. --.

Column 7,
Line 3, “canceling” should read -- cancelling --;
Lines 9 and 16, “layer” should read -- layer. --;
Line 21, “member” should read -- member. --; and
Line 65, “like .” should read -- like. --.

UNITED STATES PATENT AND TRADEMARK OFFICE

CERTIFICATE OF CORRECTION

PATENT NO. : 6,591,072 B2
DATED : July 8, 2003
INVENTOR(S) : Kouichi Hashimoto et al.

It is certified that error appears in the above-identified patent and that said Letters Patent is hereby corrected as shown below:

Column 8,
Line 13, "rotationally." should read -- rotationally --; and
Line 38, "blade 2*e*." should read -- blade 2*e*, --.

Column 9,
Line 66, "charged" should read -- charged. --.

Column 10,
Line 15, "-700V" should read -- 700V. --.

Column 12,
Line 13, "a" should be deleted; and
Line 49, "layer 4*f*" should read -- layer 4*f*' --.

Column 15,
Line 18, "phenomenon" should read -- phenomenon. --.

Column 16,
Line 4, "=2×(d×n×n + 4,500,000,000," should read -- =2×(d×n×n ÷ 4,500,000,000, --; and
Line 10, "layer if" should read -- layer 1*f* --.

Column 17,
Lines 31 and 43, "like" should read -- like. --.

Signed and Sealed this

Ninth Day of March, 2004

JON W. DUDAS
*Acting Director of the United States Patent and Trademark Office*